United States Patent [19]

Bakker et al.

[11] 4,171,555

[45] Oct. 23, 1979

[54] BUCKLE

[75] Inventors: John A. Bakker, Bartlett; David C. Boyer, Chicago, both of Ill.

[73] Assignee: Illinois Tool Works Inc., Chicago, Ill.

[21] Appl. No.: 901,658

[22] Filed: May 1, 1978

[51] Int. Cl.[2] ..... A44B 11/04

[52] U.S. Cl. ..... 24/200

[58] Field of Search ..... 24/200, 197, 169

[56] References Cited

U.S. PATENT DOCUMENTS

| | | | |
|---|---|---|---|
| 807,150 | 12/1905 | Boice | 24/200 |
| 1,324,629 | 12/1919 | Tabler | 24/200 |
| 1,999,167 | 4/1935 | White | 24/200 |
| 2,316,846 | 4/1943 | Diebold | 24/200 |
| 3,192,588 | 7/1965 | White | 24/200 |

FOREIGN PATENT DOCUMENTS

| | | | |
|---|---|---|---|
| 970611 | 9/1964 | United Kingdom | 24/197 |

*Primary Examiner*—Bernard A. Gelak

*Attorney, Agent, or Firm*—Jack A. Halvarsen; Robert W. Beart

[57] ABSTRACT

A plastic buckle adapted to adjustably secure extremities of a web-like material including a frame-like body portion, fastening means at one end of said body portion for fixedly securing the buckle to one extremity of said web-like material and means for adjusting the opposite extremity of said web-like material including at least two transverse parallel bars positioned adjacent the opposite end of said body portion. Said adjusting means including two transverse parallel bars providing edges spaced from one another on opposite sides of a plane a distance not greater than the predetermined thickness of the web and lying in spaced planes perpendicular to said first mentioned plane.

10 Claims, 10 Drawing Figures

Fig. 2
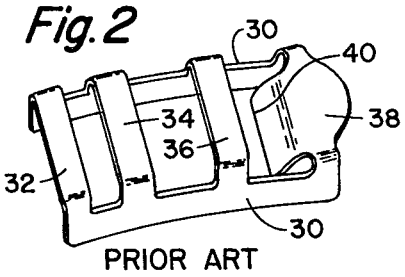
Fig. 1
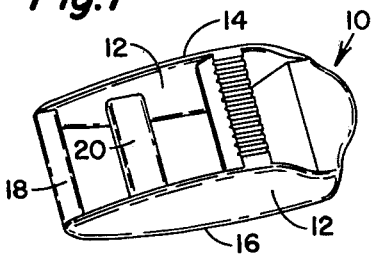
Fig. 3
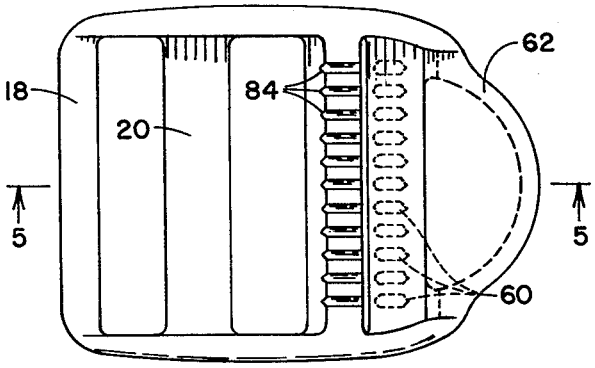
Fig. 4
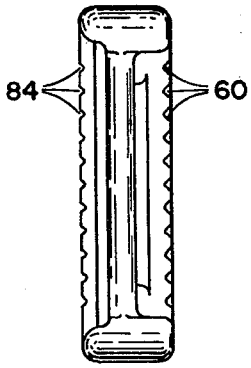
Fig. 5
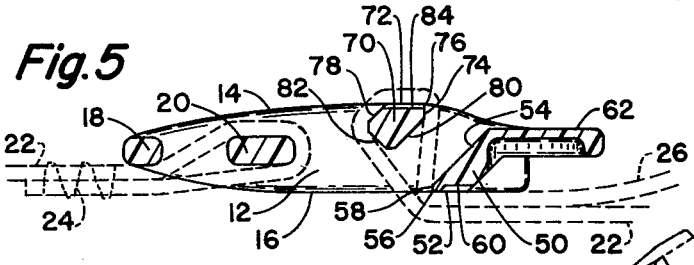
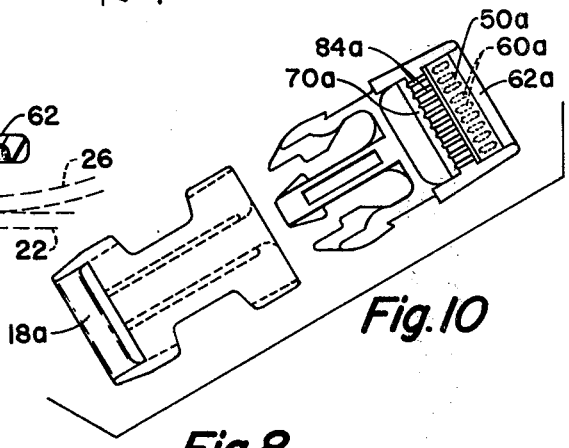
Fig. 10
Fig. 6
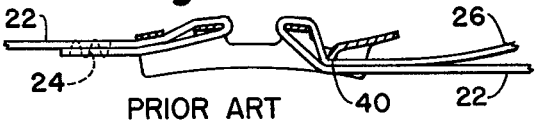
Fig. 8
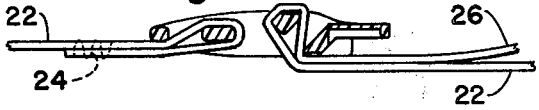
Fig. 7
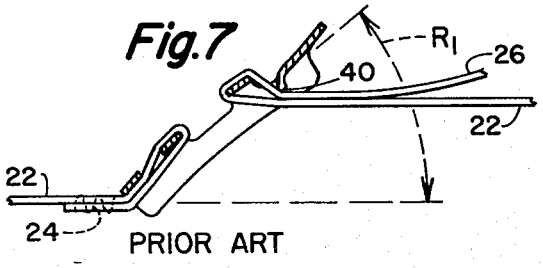
Fig. 9
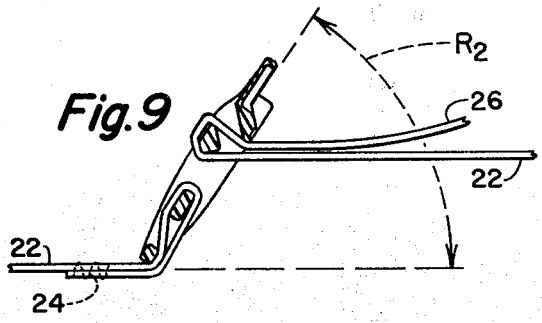

BUCKLE

BACKGROUND OF THE INVENTION

The buckle air is a sophisticated art and involves many devices used for adjusting the length of the web-like material, belting or strapping with which it is to be associated. To provide an adjustment means without the use of any moving parts has been previously shown in the patent to C. L. Hastings U.S. Pat. No. 779,279 patented Jan. 3, 1905, and the patent to F. C. Rehm U.S. Pat. No. 1,142,842 patented June 15, 1915.

Devices somewhat related to the Rehm patent are still in use today as adjustment means for lifejackets, backpacks, etc. and involve the physical fastening of one extremity of a web-like material to one end of the buckle and providing adjustment through the use of a pair of parallel bars at the opposite extremity. The Rehm patent is an improvement of Hastings' disclosure and utilizes a downwardly extending lip for impingement on the moveable free end of the web-like material to prevent its slipping from the adjusted position.

There are deficiencies in such a device, however, in that by rotating the device about its fastened end, the adjustment end can be released, either intentionally or by inadvertent pulling on the strap, by a rotation of movement of approximately 35°–45°. Nominally, the free movement of the adjusting end of the strap is accomplished by disengagement of the lip, as shown in Rehm and Hastings, from the free end of the strap to such an extent that its frictional resistance with the adjacent portion of the strap falls below a predetermined limit and movement of the strap occurs. Additionally, most of the prior art buckles are metallic in nature and subject to corrosion when used in a moist or salt water type of atmosphere.

SUMMARY OF THE INVENTION

The present invention relates to an improved plastic buckle which overcomes the corrosive effects, due to the plastic material, and provides an improved releasing angle in excess of 55°.

An additional object of the present invention is to provide means for permitting smooth transitional movement of the web-like material in one direction during adjustment and nonmovement in the opposite direction unless the buckle is disposed in the released position.

Still another object of the present invention is to provide means to prevent gathering or puckering of the web-like material across the engaging bars when the material is subjected to a transverse force.

Still another object of the present invention is. to provide an economical, corrosion-free, color compatible buckle means for the leisure and safety marketplaces.

Other objects will be apparent to those skilled in the art when the accompanying specification is read along with the drawings wherein:

BRIEF DESCRIPTION OF THE DRAWINGS

FIG. 1 is a perspective view of one embodiment of the present invention;

FIG. 2 is a perspective view of the prior art;

FIG. 3 is a plan view of the device shown in FIG. 1;

FIG. 4 is an end view taken along Lines 4—4 of FIG. 3;

FIG. 5 is an elevational view in partial section showing the interaction of this embodiment of the invention and its relationship to the web-like material with which it is to be associated, said web-like material being shown in phantom;

FIGS. 6 and 7 are elevational sectional views showing the operation of the prior art;

FIGS. 8 and 9 are elevational views in section showing the operation of the present invention; and FIG. 10 is a plan view of a separable buckle utilizing the teachings of the present invention.

DETAILED DESCRIPTION

FIG. 1 discloses one embodiment of the present invention and represents a plastic buckle 10 having a frame-like body portion defined by sides 12 which in the present instance have a substantial width adjacent one end and taper towards the opposite end. The sides 12 are interconnected by a plurality of transversely extending parallel bars. The upper edge 14 of the sides 12 define the upper face of the buckle, while the lower edges 16 define the lower face of the buckle.

In this embodiment the transverse bars 18 and 20, spaced from each other but positioned adjacent one end of the buckle 10, serve as the permanent fastening means of the buckle by permitting the web-like material 22, as seen in phantom in FIG. 5, to be fed between the bar 18 and the bar 20, around the bar 20 and then fastened as at 24 by sewing or other suitable means such as riveting.

Before proceeding with the description of the essence of the present invention, please refer to FIG. 2 which shows the prior art type of buckle which is used extensively in adjustment means for lifejackets and other equipment. Such a device is sheet metal having a pair of side rails 30 and a plurality of transversely extending bars 32–38 with the last bar 38 including a depending lip portion 40. As can be best seen in FIG. 6, a webbing member 22 is laced between bars 32 and 34 and wrapped around bar 34 and secured by suitable means such as sewing. At the opposite end the free or adjustable portion of the webbing 22 has its free end 26 wrapped around bar 36 and caused to underlie the lip 40 where it impinges on the free end 26 against the main portion of the web-like material 22 to retain same in an adjusted relationship. This generally describes the operation of the prior art and will be referred to later in this description.

The present invention device provides a pair of bars adjacent one end of the sides 12 with the first bar 50 having a first surface 52 falling substantially in the plane passing through the lower face 16 of the buckle. A second acutely disposed adjoining surface 54 forms a generally sharp abrupt corner edge 56. This preferred embodiment also has a third surface 58 which is disposed substantially normal to said first surface and obtusely relative to the second surface 54 to "dub-off" the juncture between the first surface 52 and the second surface 54 to thereby provide a stronger sharp corner 56. The first surface 52 also includes a plurality of spaced groove means 60 which extend in the direction of the side walls 12 but do not break through or traverse the sharp corner 56, for purposes best set forth hereinafter.

Suitable engaging means, such as the flat handle 62 are provided adjacent the end of the body portion 12. In this embodiment, the handle is a continuation or extension of the bar 50 and its use will be explained hereinafter.

The second bar 70 making up the adjustment means includes a top surface 72 lying substantially in the plane of the upper face 14 and is joined with a second surface 74 to form a sharp corner edge 76 having an included angle not exceeding 90°. Bar 70 has a third surface 78 disposed obtusely relative to surface 72 to provide a smooth transition of movement of said web as it is fed over the top surface 72. A fourth surface 80 and a fifth surface 82 fall away abruptly from the second and third surfaces 74–78, respectively, to prevent engagement with the webbing 22 as it moves around the bar 70. The upper surface 72 is similarly provided with a plurality of spaced groove means 84 which serve a similar function to the groove 60 in preventing a gathering or bunching up of the web-like material and maintain it in a flat condition as it progresses around the bar. The grooves 84 extend across the entire width of the bar 70 and intersect the junctures of surface 72 with surfaces 74 and 78.

It will be noted that the disposition of the second surface 74 and the sharp corner 76 are in general opposition to the sharp corner 56 and the surface 58 of the first bar 50. A plane passing through the side walls 12 and parallel to bars 50 and 70 will provide a spacing on opposite sides thereof, as measured from said plane to the sharp corners 56 and 76, and will have a cumulative distance not greater than the thickness of the webbing material 22. Thus, as can be seen in FIG. 5, the webbing 22 is fed under the belt, up through the gap between bar 70 and bar 20, over bar 70 and thence down under bar 50 to thereby overlie the basic web material in impinging relationship. Additionally, it will be noted that the webbing, as its extends between sharp corner 76 and engagement by sharp corner 56 with its opposite surface, it slightly inclined in a reverse direction, thereby insuring high pressures at the engagement of sharp corner 56 against the webbing.

In test results, it has been shown that the prior art device illustrated in FIGS. 2, 6 and 7 can be released by engaging the end closest to the lip 40 and raising it upwardly. The point at which the free end 26 of the webbing 22 is released is approximately 35°–40° which is designated as $R_1$ in FIG. 7.

In the present device, as best seen in FIGS. 5, 8 and 9, the design as shown will not release until the angular relationship between a normal position and the release position, where the strap free end 26 is capable of ready movement, is approximately 55°–60°, this angularity being designated as $R_2$ in FIG. 9.

The operation of the present device, this embodiment being a one-piece molded plastic part from any suitable plastic material having the proper structural characteristics, permits a ready transitional movement by pulling on the free end 26 to move the web material 22 past the fifth surface 82 of bar 70, up the third surface 78, across the top surface 72 and thence down the facing surface 74 and under the lower surface 52 of bar 50. To release the buckle an upward force, as viewed in the drawings, is applied to the handle 62, until the handle reaches an approximate position similar to that shown in FIG. 9 at which time a pulling force can be exerted on the web-like material 22 to foreshorten the free end 26 or to remove it from the buckle in its entirety.

A second embodiment of the present invention is shown in FIG. 10 in which the teachings of the present invention are applied to a separable buckle. The style of separable buckle illustrated is shown in the co-pending application for U.S. Letters Patent, Ser. No. 823,227, filed Aug. 10, 1977, assigned to the common assignee of the present invention. In this embodiment a single fastening bar **18*a* will accept one extremity of the web-like material which is fastened to itself by sewing or other suitable means. In the second half of the buckle there is provided a bar 50*a* and a bar 70*a* both of which have substantially the identical cross sectional configuration of the first embodiment. They also include the spaced groove means 84*a* on bar 70*a* and groove means 60*a* on the undersurface of bar 50*a*. A ledge 62*a*** is provided for purposes of releasing the free end of the web material, not shown, for adjustment purposes.

Other embodiments of the present invention will be apparent to those skilled in the art.

I claim:

1. A plastic buckle adapted to adjustably secure the extremities of a length of web-like material having a predetermined thickness, said buckle including a frame-like body portion having sides and ends defining an upper and lower face of said buckle, fastening means at one end of said body portion for fixedly securing the buckle to one extremity of said web-like material, means for adjusting the opposite extremity of said web-like material including at least two transverse parallel bars positioned adjacent the opposite end of said body portion with said bars having web engaging surfaces lying in different planes generally falling on said upper and lower faces of said buckle, a first one of said bars forming the end of said frame-like body portion, said first bar having a substantially flat first surface lying substantially on said lower face and a second acutely disposed adjoining surface, said first and second surfaces of said first bar are joined by a third intermediate surface disposed substantially normal to said first surface and obtusely relative to said second surface thereby forming a generally sharp abrupt corner edge, the second transverse bar being spaced from said first bar and including a substantially flat first surface lying substantially on said upper face and a second adjoining surface forming a corner edge having an included angle not exceeding 90°, said edges facing in opposed relation and lying on opposite sides of a plane perpendicular to said faces and parallel to said bars, said edges being spaced from each other along a line perpendicular to said last mentioned plane a distance not greater than the predetermined thickness of said web, whereby said web-like material as it extends between said corner edges of said first and second bars is inclined in the direction of said second acutely disposed surface of said first bar to thereby insure high unit pressure at the engagement of said sharp corner of said first bar against said web-like material.

2. A buckle of the type according to claim 1, further including a plurality of spaced groove means on the said substantially flat first surface of said bar, said groove means extending parallel to said sides of said body portion.

3. A buckle according to claim 2 wherein said groove means only extends partially across said bar and terminates short of intersection with said abrupt corner edge.

4. A buckle according to claim 1 wherein said second bar includes a third surface obtusely joining said first surface opposite its juncture with said second surface to thereby provide a smooth transition of movement of said web between said first and third surfaces.

5. A buckle according to claim 4 wherein said second bar includes fourth and fifth surfaces that fall abruptly away from and provide relief from their juncture with the second and third surfaces to thereby provide smooth transitional movement of said web in one direction.

6. A buckle according to claims 4 or 5 wherein said first surface includes a plurality of spaced grooves extending between its junctures with said second and third surfaces, said grooves acting to prevent gathering or bunching of said web along said second bar.

7. A buckle according to claim 1 wherein said fastening means at one end of said body includes at least one transverse bar around which said web is looped and thence suitable fixed to itself.

8. A buckle according to claims 1 or 7 wherein said buckle is a detachable two-piece buckle with said fastening means attached to one end of one half of the buckle while the means for adjusting including the two transverse bars forms the opposite end of the other half of the buckle.

9. A buckle according to claim 1 wherein said body portion includes handle-like engaging means to permit angular movement of said buckle about said fastening means to permit disengagement of said web-like material from the adjusting means.

10. A buckle according to claim 1 wherein said edges of said two bars are spaced from each other a distance less than the predetermined thickness of said web.

* * * * *